United States Patent [19]

Sweeney

[11] 3,933,209

[45] Jan. 20, 1976

[54] DRILLING APPARATUS AND TECHNIQUE USING DOWN-HOLE MOTOR

[75] Inventor: Gerald T. Sweeney, Federal Way, Wash.

[73] Assignee: Tigre Tierra, Inc., Puyallup, Wash.

[22] Filed: Mar. 1, 1974

[21] Appl. No.: 447,360

Related U.S. Application Data

[63] Continuation-in-part of Ser. No. 283,208, Aug. 23, 1972, Pat. No. 3,854,539.

[52] U.S. Cl. ..... 173/80; 175/257

[51] Int. Cl.[2] ..... E21B 5/00

[58] Field of Search ..... 175/58, 92, 105, 236, 257, 175/296, 389, 390; 173/72, 73, 80, 91

[56] References Cited

UNITED STATES PATENTS

| | | | |
|---|---|---|---|
| 1,717,271 | 6/1929 | Simmons | 175/105 |
| 3,292,717 | 12/1966 | Hall et al. | 175/236 |
| 3,524,511 | 8/1970 | Klemm | 175/92 |
| 3,635,295 | 1/1972 | Cobbs | 175/257 |
| 3,682,260 | 8/1972 | Klemm | 175/92 |

*Primary Examiner*—James A. Leppink
*Attorney, Agent, or Firm*—Christopher Duffy

[57] ABSTRACT

The disclosure includes additional features of the apparatus and technique disclosed in Applicant's U.S. Pat. No. 3,854,539 and U.S. Pat. No. 3,874,464. For example, in one embodiment, the anvil is relatively rotatably interconnected with the piston-like member, and is adapted to engage the drill rod for conjoint rotation therewith. Moreover, the inner drill bit has a port in it for discharging the exhaust fluid into the working face of the outer bit from a passage in the anvil. In another embodiment, the anvil includes a core barrel which is adapted to register with the opening in the abutment, when the anvil is engaged with the abutment. The core barrel is defined by a tube which is detachably connected with the main body of the anvil at the relatively forward end thereof. After the tube has been detached from the anvil, the core sample is discharged from the tube through an opening in the relatively rearward end thereof, there being a core catcher means in the tube which is operable to retain the core sample against escape through the relatively forward end thereof. Manipulatively, the additional features include a process for installing an elongated element, such as a tube, in an earth formation. In the process, a drill rod is driven into the formation, having inner and outer bits at the distal end thereof, the inner of which is retractable from the rod through the bore of the pipe. After the inner bit is retracted, the elongated element is inserted in the bore, and then the rod is retracted from the hole about the element. Additionally, the added features include a process for removing a core sample from beneath overburden, using the foregoing pair of bits. After the inner bit is retracted from the bore, a core barrel is inserted in the bore, and the hole is excavated still further while the core barrel is driven forward in unison with the drill rod and adjacent the opening of the outer bit. The barrel is then retracted from the bore to remove the sample from the formation.

10 Claims, 19 Drawing Figures

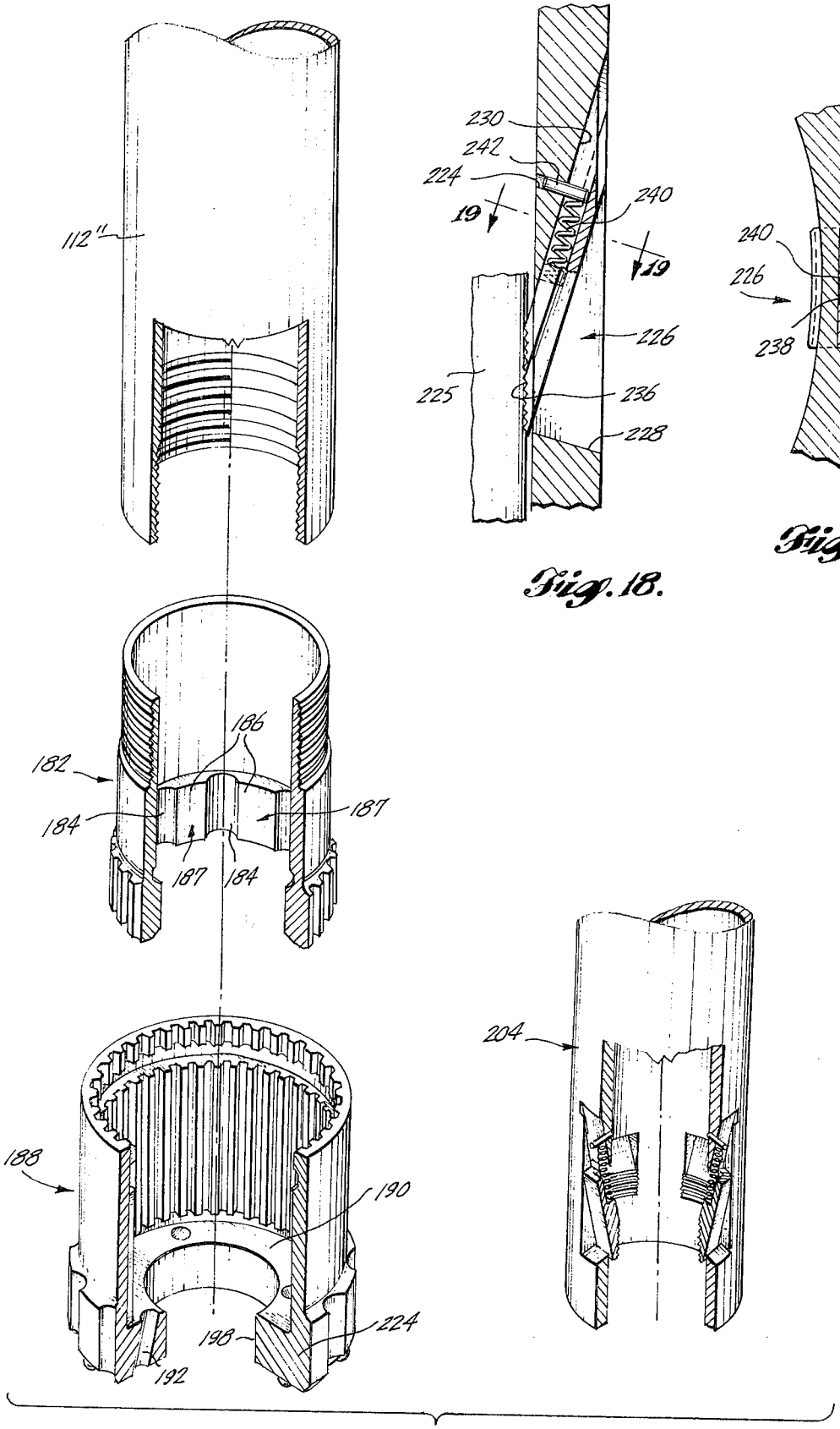
Fig. 11.
Fig. 18.
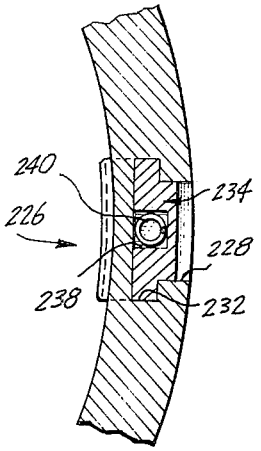
Fig. 19.

DRILLING APPARATUS AND TECHNIQUE USING DOWN-HOLE MOTOR

RELATED APPLICATION

The present Application is a Continuation-in-part of my earlier Application 283,208, filed Aug. 23, 1972, and now U.S. Pat. No. 3,854,539, entitled "Drilling Apparatus with down-hole Motor."

This invention relates to a drilling apparatus and technique which employ a rotary drill rod and a down-the-hole motor for applying hammer blows to the rod while it is rotated into the earth or other formation to be drilled. The motor employs a standard fluid operated, down-the-hole hammer mechanism, and a fluid transmission means for the same which does not add appreciably to the down-the-hole weight of the motor, and does not require rotating. In fact, if desired, the motor can be installed in the bottom of the bore of a pipe which is relatively stationary, and then operated in a dead weight condition, using the bore of the pipe as a means for transmitting the fluid to the hammer mechanism. Thereafter, when the motor is to be removed from the pipe, a standard wire-line retriever or the like can be lowered into the bore to lift the motor from the pipe.

The drilling operation need not be limited to drilling vertically downward, but in fact, may be conducted in any direction, including in the vertical overhead direction. Also, the apparatus and technique can be employed for many types of drilling operations, since after the motor has been removed from the pipe, the pipe provides clear, open, unobstructed, and yet fully supported access to the bottom of the drill rod, or at least to a bit at the distal end of the pipe, depending on the mode of operation. Therefore, the apparatus and technique may be employed for many types of operations, including core barreling, alternate drilling and core barreling, and casing of a drilled hole, either with or without simultaneously core sampling the hole. Also, the apparatus and technique may be employed to install a drill rod which is left in the hole.

As in the case of the apparatus and techniques disclosed in my aforementioned Application, the drill rod includes a pipe having a longitudinally extending bore therethrough and a percussive bit at the distal end thereof. The motor comprises a piston-like member which is adapted to be slidably inserted in the bore of the pipe and has the hammer mechanism thereon. The hammer mechanism is used to apply blows to an abutment which is disposed relatively transverse the bore adjacent the bit and operatively connected with the bit to receive and transmit the hammer blows into the working face of the bit. There are also fluid transmission means for operating the hammer mechanism, means for passing fluid through the piston-like member, and means for exhausting the fluid into the region adjacent the working face of the bit after the mechanism has operated. Also, there are means on the rod whereby the exhausted fluid can discharge from said region toward the proximal end of the pipe on the opposite side of the pipe from the piston-like member, and means on the piston-like member for generating a pressure differential across the motor longitudinally of the bore to maintain the hammer mechanism in operative relationship to the abutment during the application of the hammer thereto.

According to one feature of the invention, the percussive bit is annular, and has an inner bit adjacent the opening thereof, which is retractably suspended from the piston-like member and operatively inter-engaged with the drill rod to rotate in conjunction with the annular bit. The inner bit has a fluid passage therethrough, and the fluid is exhausted through the passage into the region adjacent the working face of the bit after the hammer mechanism has operated. The pipe may be conjointly rotatable with the bits; and the annular bit may be displaceable in relation to the pipe, axially of the bore, as for example, where the annular bit is splined to the pipe axially of the bore. Similarly, the respective bits may be splined to one another, axially of the bore.

According to another feature of the invention, the annular bit has an excavation means adjacent the opening thereof, which is retractably suspended from the piston-like member and operatively interposed between the hammer mechanism and the bit to receive and transmit the hammer blows into the working face of the bit. Again, the excavation means may take the form of an inner bit, and the inner bit may be seated on an annular shoulder on the annular bit. Alternatively, the excavation means may take the form of a core barrel which is so seated on the annular bit.

According to still another feature of the invention, the motor also includes an anvil which is adapted to be inserted in the bore of the pipe forwardly of the piston-like member, and engaged with the abutment to receive and transmit the hammer blows into the abutment. The abutment may open into the working face of the bit and there may be an excavation means on the anvil which is adapted to insert into the opening of the abutment when the anvil is engaged with the abutment. Moreover, the anvil may be relatively rotatably interconnected with the member and adapted to engage the rod for conjoint rotation therewith. Also, the anvil may have a fluid passage therethrough, and the excavation means may have a port therein for discharging the exhaust fluid into the working face of the bit from the passage.

Alternatively, there may be an excavation means in the anvil which is adapted to register with the opening in the abutment when the anvil is engaged with the abutment. The excavation means may take the form of a core barrel, and the core barrel may be defined by a tube which is detachably connected with the main body of the anvil at the relatively forward end thereof. The tube may have core catcher means therein, which are operable to retain the core sample against escape through the relatively forward end of the tube, and there may be an opening in the relatively rearward end of the tube through which the sample can be discharged from the same after the tube is detached from the main body of the anvil.

The invention also includes a process for installing an elongated element, such as a tube, in an earth formation. According to the process, a hole is excavated in the earth formation by driving a rotary drill rod into the same, comprising an elongated pipe having a longitudinally extending bore therethrough and a pair of inner and outer bits at the distal end thereof. The outer of the bits is annular, and the inner of the bits is inserted in the rod adjacent the opening of the annular bit and retractable from the rod through the bore of the pipe. Manipulatively, the inner bit is retracted from the bore, the elongated element is inserted in the bore, and then the rod is retracted from the hole about the element. The down-the-hole motor may be inserted in the bore to drive the rod during the excavating stage, and then retracted from the bore before the element is inserted therein. Also, the motor and the inner bit may be interconnected with one another so as to be conjointly retractable from the bore.

Another manipulative aspect of the invention relates to a process for removing a core sample from an earth formation. According to this latter process, a hole is excavated in the formation by driving the drill rod into the same, and then the inner bit is retracted from the bore of the pipe and a core barrel is inserted in the bore. Then the hole is excavated still further while the core barrel is driven forward in unison with the drill rod adjacent the opening of the outer bit, to collect a core sample in the barrel. Then the barrel is retracted from the bore to remove the sample from the formation. The down-the-hole motor may be inserted in the bore to drive the rod and the core barrel during the further excavation stage, and then retracted from the bore before the sample is removed from the formation. Also, the motor and the core barrel may be interconnected with one another so as to be conjointly retractable from the bore.

BRIEF DESCRIPTION OF THE DRAWINGS

These and other features of the invention will be better understood by reference to the accompanying drawings wherein certain of the presently preferred embodiments of the invention are illustrated.

FIG. 11 is an exploded, part perspective view of a third embodiment which is adapted for alternate drilling and core barreling;

FIG. 5 is a fourth such view of the third embodiment in the core barreling phase of the alternate operation;

FIG. 18 is a part longitudinal cross-sectional view of the core barreling tube, illustrating the operation of a core catcher means incorporated into the tube; and, FIG. 19 is a cross-sectional view along the line 19—19 of FIG. 18.

DESCRIPTION OF THE PREFERRED EMBODIMENT

Figure 1:
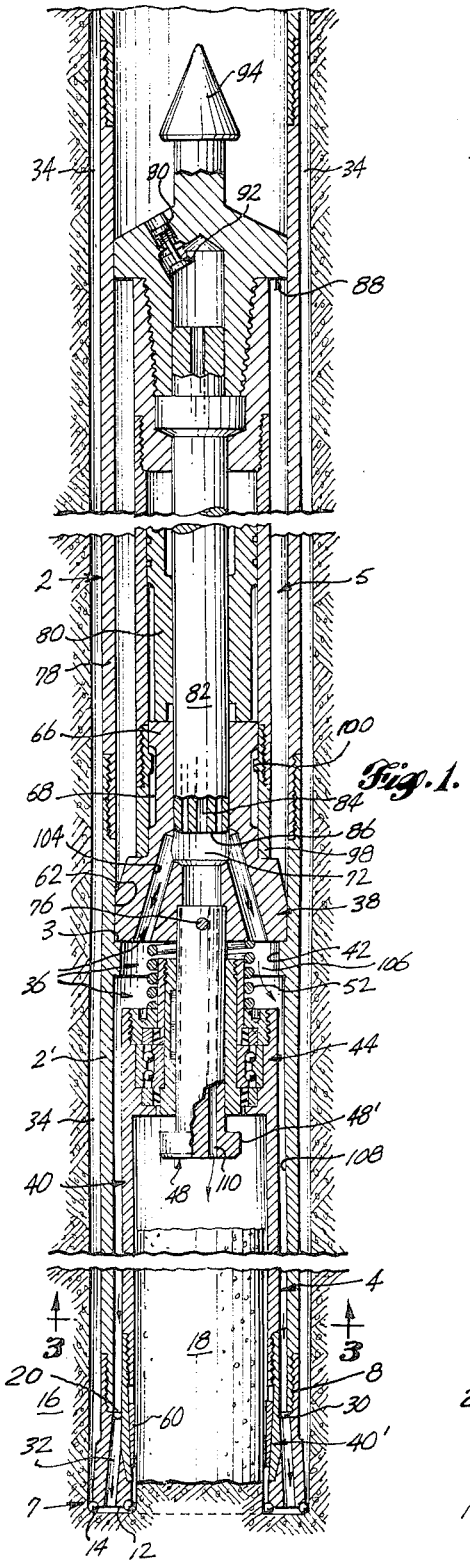
FIG. 1 is a part longitudinal cross-sectional view of one embodiment of the apparatus, as it is seen in use for a core drilling operation, and with the hammer in the bottomed condition thereof.
Figure 2:
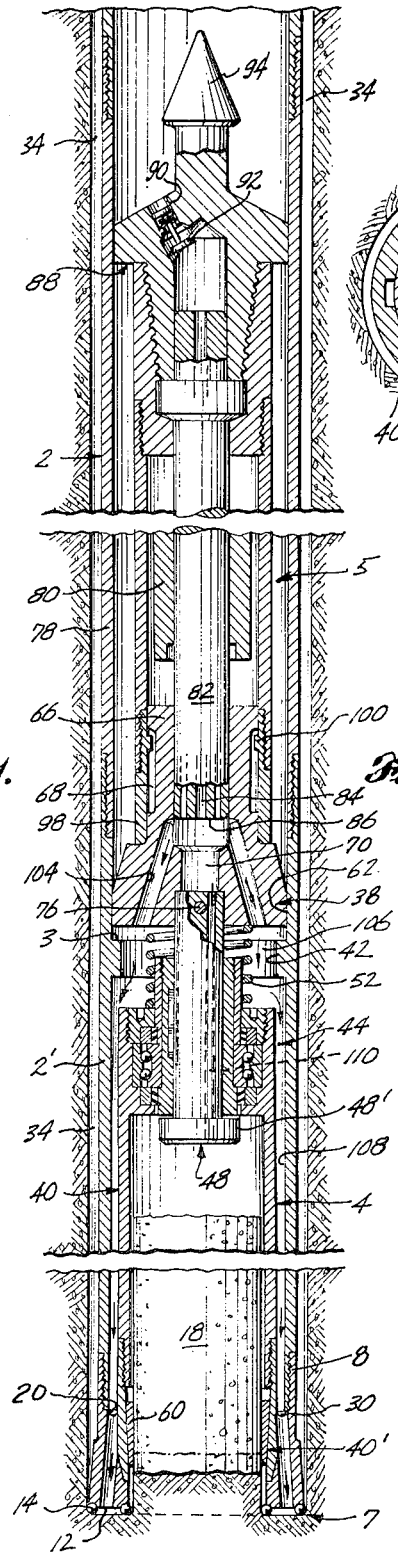
FIG. 2 is another such view when the hammer is in the upstroke thereof.
Figure 3:
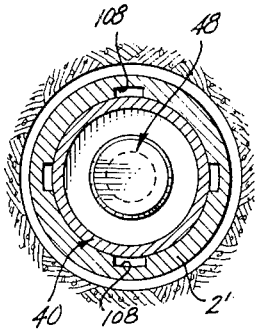
FIG. 3 is a transverse cross-sectional view along the line 3—3 of FIG. 1.
Figure 4:
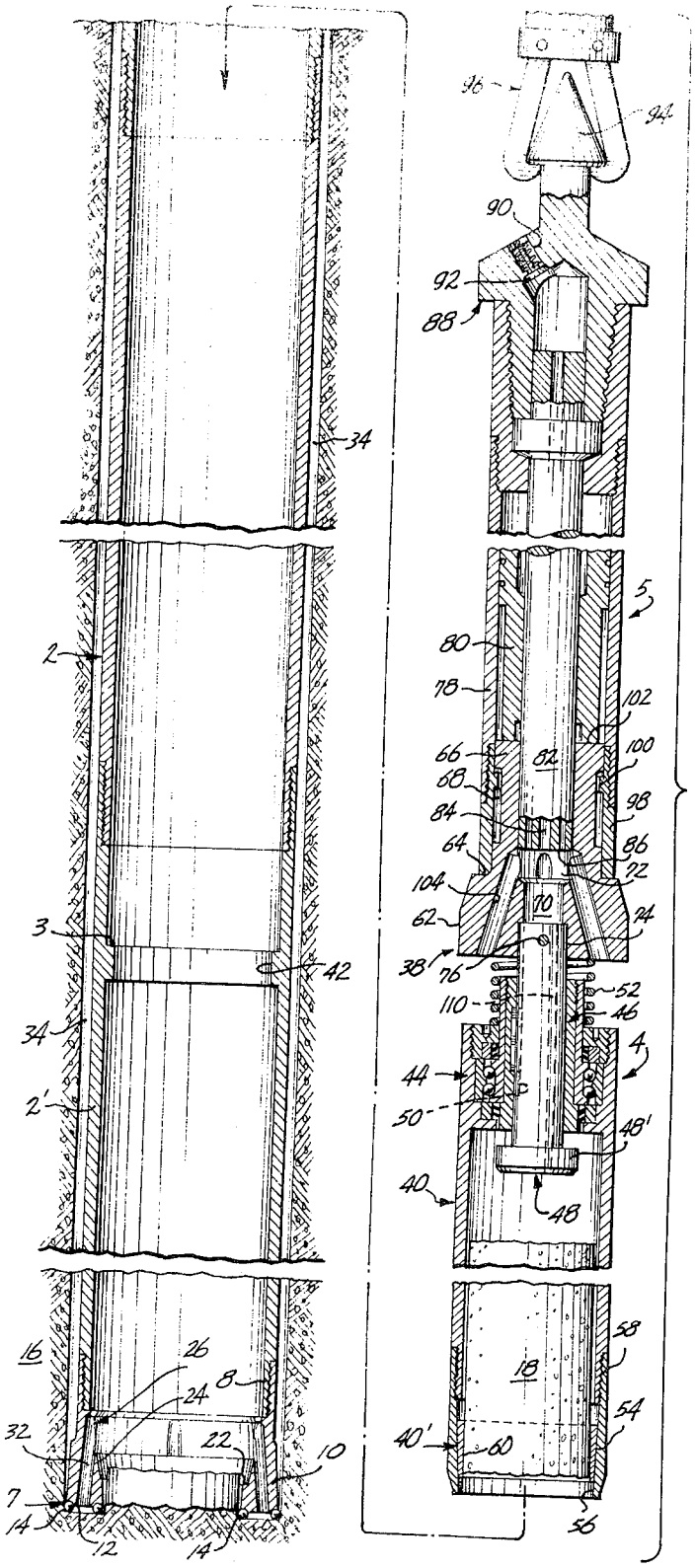
FIG. 4 is another part longitudinal cross-sectional view of the apparatus after the motor has been retracted from the drill rod.
Figure 5:
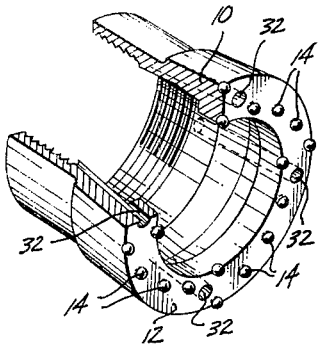
FIG. 5 is a part perspective view of the bit employed in the drill rod.
Figure 6:
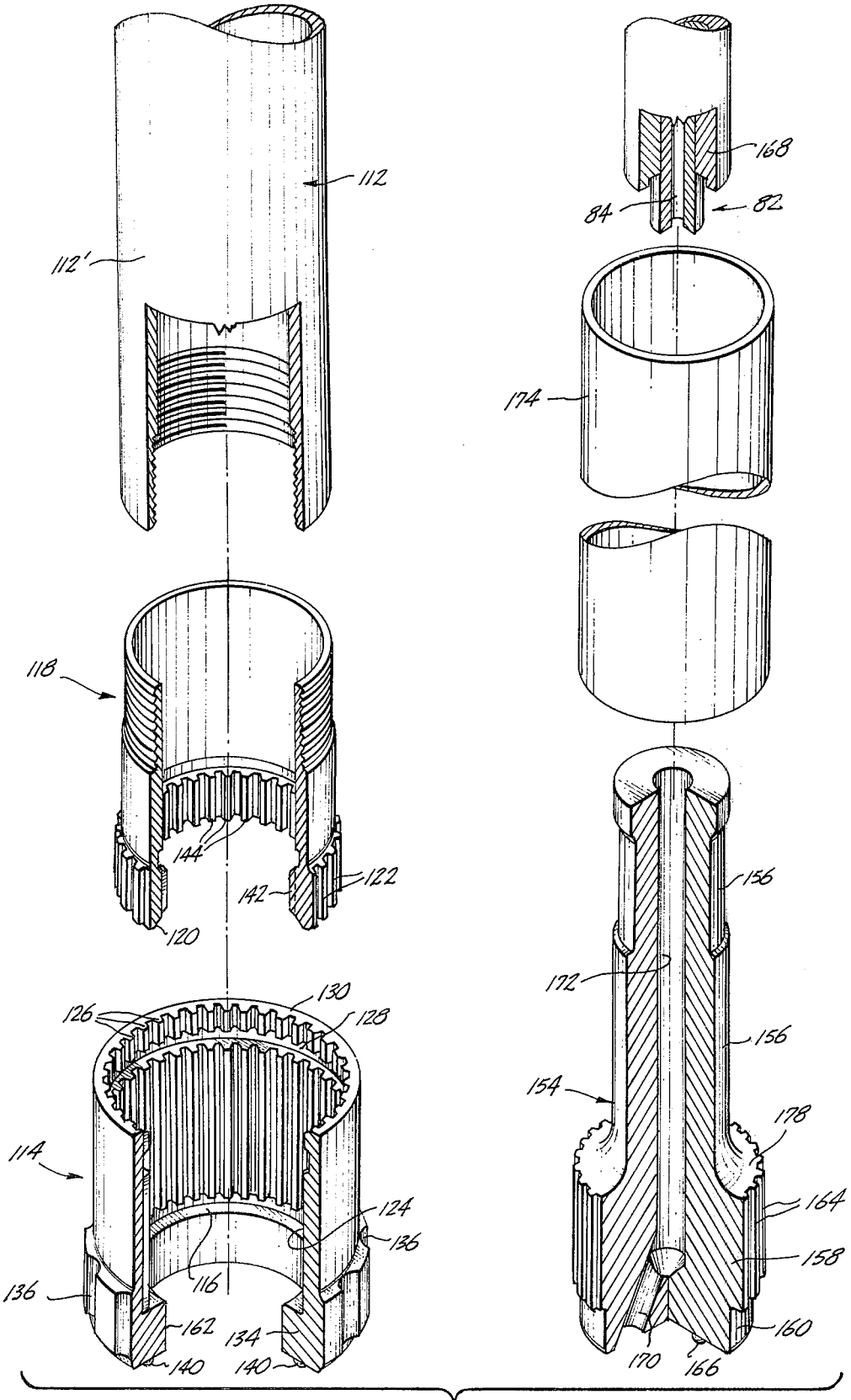
FIG. 6 is an exploded, part perspective view of another embodiment of the apparatus.
Figure 7:
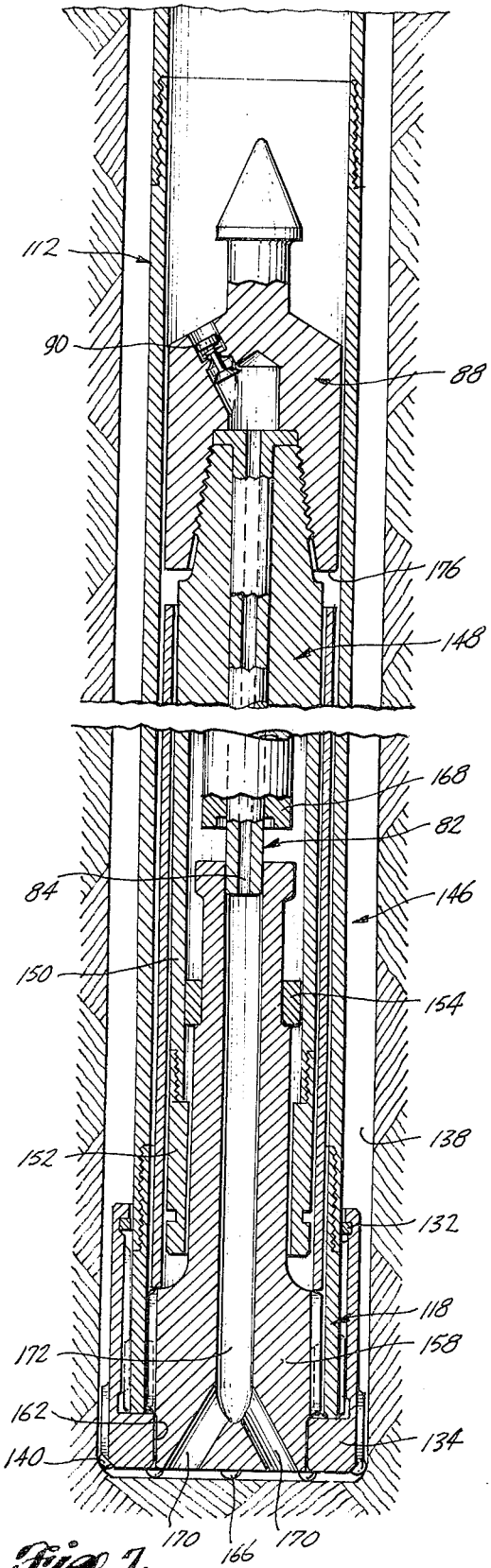
FIG. 7 is a longitudinal, cross-sectional view of the second embodiment when the hammer is in the raised or actuated condition thereof.
Figure 8:
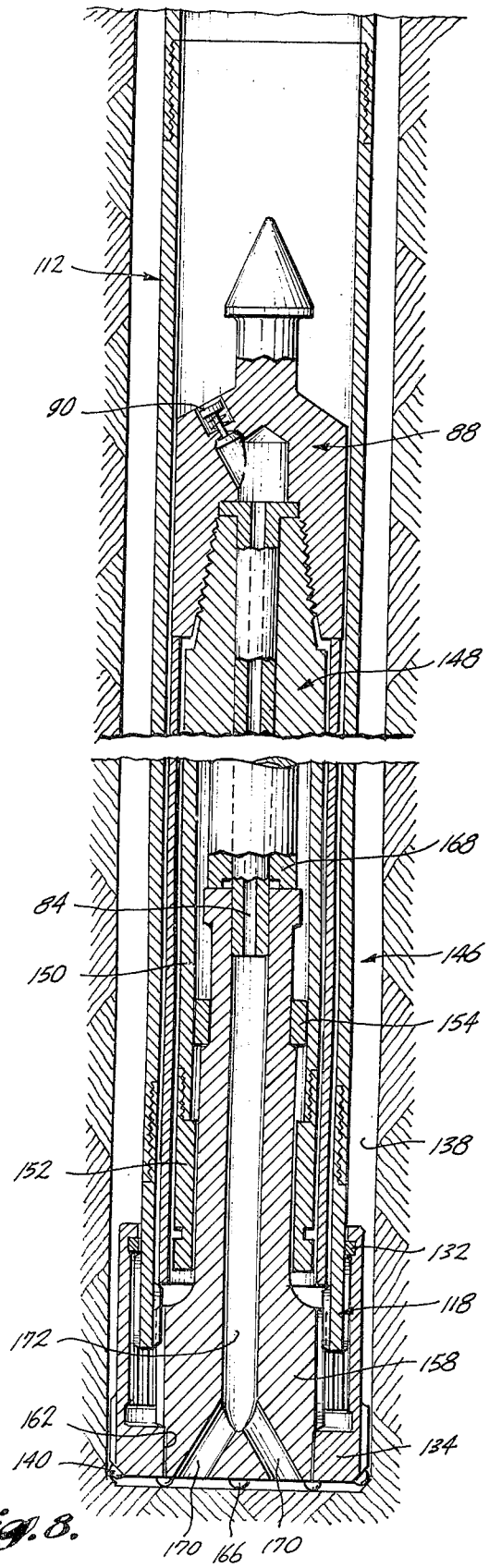
FIG. 8 is another such view of the second embodiment when the hammer is in the lowered or deactuated "blow cycle" condition thereof.

Referring to the drawings, it will be seen that the drill rod in FIGS. 1–5 comprises an elongated, fluid pressurized drill pipe 2, which is assembled from equal-diameter sections that are perhaps 10' in length and threaded and flush-coupled to one another as illustrated. With the exception of the interior of the bottommost or distal end section 2' of the pipe, the sections are otherwise similar to one another, and are added to and subtracted from the pipe as is necessary during the drilling operation. The distal end section 2' differs, however, in that it has a stepped or counterbored interior configuration which forms an inner peripheral shoulder 3 at a point near the top thereof. The shoulder serves as an abutment for the motor 4, which is insertable and retractable in and from the rod, as shall be explained, and which includes a standard, fluid operated down-the-hole hammer mechanism 5.

The pipe is pressurized and driven by a conventional drilling mechanism, such as that shown in U.S. Pat. No. 3,391,543, and is typically driven at slow speeds such as 10 RPM, that is, at speeds simply sufficient to index the percussion bit 7 seen at the bottom or distal end of the pipe. The bit 7 is annular in configuration, and has an interiorly threaded collar 8 at the upper end thereof, that flush-couples to the distal end section 2' of the pipe. Below the collar, however, the bit is flared radially outwardly and forms an enlarged head 10 which terminates with a flat-faced annulus 12 at the working end thereof. The annulus has sets of button-like percussion points 14 seated in raised condition thereon, which are spaced apart in angularly spaced, clockwise, convolutional lines that are symmetrically arranged about the axis of the bit. See FIG. 5. In addition, the endmost points 14 on each line, are seated in the head so as to project slightly inside and outside of the inner and outer peripheries of the annulus, respectively. As a consequence, when the rod is rotated and hammered into an earth formation 16, the bit excavates an annular recess the outside diameter of which is not only greater than the outside diameter of the pipe, but also greater than the outside diameter of the flared head 10 of the bit. Likewise, the core 18 of earth material which is captured within the end of the rod, has an outside diameter of slightly lesser dimension than the inside diameter of the head of the bit.

Otherwise, the bit has a stepped or counterbored interior configuration forming an annular shoulder 20 inside of and about the bottom end of the collar 8. The interior of the bit also has another annular shoulder 22 therebelow, which is of lesser inside and outside dimensions than the shoulder 20, by virtue of there being an inwardly chamfered surface 24 at the bottom of the cylindrical socket 26 separating the two shoulders. The lower shoulder 22 and the socket 26 form a seat for a core barreling tube 40 on the motor, as shall be explained; whereas the upper shoulder 20 has an annular groove 30 recessed therein, from which a series of symmetrically angularly spaced ports 32 open through the body of the head 10 to the working face 12 of the bit, between the points 14 thereon. The ports are also canted to the axis of the head, and are so angled into the shoulder that they open into the socket 26.

During the drilling operation, the compressed fluid is intermittently discharged to the ports 32 to flush the removed earth material back through the clearance 34 between the pipe 2 and the wall of the excavation. The fluid reaches the ports through a series of passages 36 which are formed within the motor and the distal end section 2' of the pipe, as shall be explained more fully hereinafter.

The motor includes an annular anvil 38 which is slidably engageable in the upper, thinner walled portion of the distal end section 2', and sized to seat on the shoulder 3. The core barreling tube 40 is slidably engageable in the bore 42 of the lower, thicker walled portion of the section 2', and suspended from the anvil to seat relatively rotatably within the socket 26 of the bit. The tube is equipped with a bushed, ball bearing mounted swivel head 44 on the upper end thereof, and the bushing 46 of the head is slidably engaged on, but rotationally keyed to a flanged swivel pin 48, which is fastened upright to the underside of the anvil. Moreover, the keyway 50 for the bushing, and the length of the bushing, are sized in relation to the pin, to allow for play between the tube and the anvil, axially thereof; and a coiled spring 52 is interposed about the bushing 46, between the head and the underside of the anvil, to bias the tube in the downward direction, toward the flange 48' of the pin. Thus, when the motor 4 is lowered into the bore of the pipe 2, the tube 40 is urged to seat within the bit, both by the spring 52 and by the forces of gravity; yet it is also free to undergo displacement in relation to the anvil, where there is earth material lodged within the bit. The earth material may be dislodged, however, either by the anvil, or by the fluid discharge, or by both, as shall be explained hereinafter.

In addition to being adapted to mate with the bit, the forward end portion 40' of the tube 40 is also adapted to "lift" or separate the core 18 from the earth formation when the drive means 4 is retracted from the rod. The tube 40 is formed in two threaded and flushed-coupled parts, the more forward 40' of which is chamfered at the end, so as to mate with the chamfered socket 26 of the bit, and form an essentially airtight joint therebetween. The more forward portion 40' also has an upwardly and outwardly tapered surface 54 formed between the cylindrical mouth 56 and the threaded collar 58 of the same; and when the two parts of the tube are assembled, a tapered wedge-like annular core lifter 60 is inserted within the more forward portion, to perform the core lifting and separating function in conventional fashion.

The outer cylindrical surface 62 of the anvil is closely machined to form a fluid seal with the bore of the pipe. Above th surface, however, the anvil is swaged inwardly and provided with a filleted shoulder 64 thereabout, from which a nipple-like shank or embossment 66 is upstanding on the axis of the anvil, and equipped with a wide circumferential groove 68 thereabout. The bore 70 of the anvil is counterbored from above and below, and the upper counterbore 72 of the same is adapted to interengage with the hammer mechanism, as shall be explained, whereas the lower counterbore 74 provides a socket for the swivel pin 48, which is secured in the socket by means of a dowel 76.

The hammer mechanism 5 is a somewhat modified version of a standard down-the-hole air hammer mechanism, comprising an outer tubular casing 78 having a pipe hammer 80 reciprocably engaged about a stationary control rod 82 therein. The control rod 82 is ported and infrastructured to enable the compressed fluid to reciprocate the hammer in known manner, and alternately to exhaust through porting 84 in the distal end 86 of the control rod. The fluid enters the control rod through a port or ports 90 in a spear-headed, piston-like cap 88 which is threaded onto the upper end of the casing and adapted to relatively slidably engage with the wall of the bore of the pipe 2. The ports 90 are equipped with spring-loaded throttle valves 92 that operate to produce a pressure drop between the upper and lower sides of the motor, so that the fluid can assist in seating the anvil on the shoulder 3 of the pipe.

The anvil 38 is coupled to the hammer mechanism by telescopically engaging a threaded, two-part, inner ribbed collar 98 about the embossment 66 of the anvil, and flush-coupling the collar to the distal end of the casing 78, the inner circumferential rib 100 of the collar, meanwhile interengaging in the groove 68 of the embossment. The motor is retracted from the rod by an overhead hoist, such as a standard wire-line retriever, the dogs 96 of which are engaged about the spearhead 94 of the cap.

During the drilling operation, the hammer 80 interfaces with the annulus 102 at the upper end of the anvil, and applies intermittent blows to the anvil as the pipe 2 is rotated thereabout. Thus, the bit is continually advanced in the axial direction by the percussive effect of the hammer, and at the same time, is continually rotated by the pipe, so that the points 14 of the bit are reindexed with respect to the face of the excavation, each time that the hammer strikes. Moreover, due to the telescoping relationship between the tube 40 and the pipe, and the relatively reciprocable, swiveled relationship between the tube and the anvil, the tube remains substantially stationary with respect to the pipe, as the pipe is rotated and advanced into the formation.

During the drilling operation, moreover, the exhaust porting 84 in the control rod is placed in communication with the passages 36, so as to exhaust the fluid about the bit. As seen, the distal end portion 86 of the control rod is slidably inserted in the bore 72 of the anvil; and in the bore, there is a series of symmetrically angularly spaced and outwardly slanted ports 104, which open to the underside of the anvil, opposite the chamber 106 which is formed between the head 44 of the tube and the anvil. From there, the fluid enters a series of symmetrically angularly spaced flutes 108 in the bore 42 of the rod, which commence below the level of the shoulder 3, and terminate in the distal end of the rod, to communicate with the groove 30 and the ports 32 in the bit. In the engaged and socketed condition of the tube 40, the open sides of the flutes are closed by the main body of the tube, and the socket 26 is occupied by the forward portion 40' thereof, so that the fluid can escape only through the ports 32. Until the tube is socketed in the bit, however, a portion of the fluid will discharge through the axial opening of the bit, so as to assist in flushing out any accumulated debris which would otherwise prevent the tube from seating in the socket of the bit.

Moreover, in such a case, the spring 52 will be compressed by the tube to the point where the bushing 46 of the swivel head engages the face of the anvil; and thereafter, when the hammer 80 is applied to the anvil, the force of the hammer will operate on the tube only, until the anvil re-engages the shoulder 3 of the rod. Thus, the operator can be assured that the tube will be properly seated before the drilling operation is begun.

In the seating process, moreover, a passage 110 through the pin 48, assures that the tube 40 is also pressurized, so that the debris can move only in the direction outward through the clearance 34.

Of course, as drilling progresses, more and more sections are added to the pipe 2. If necessary or desired, the tube can be changed at the same time to account for wear of the inner points of the bit; or the bit can be changed; or both can be changed.

For overhead or sidewall drilling, the fluid may also be employed as a means of seating the motor; as for example, where the motor is run into the pipe at a pressure below that at which the valves 92 are open, and then the pressure is raised to open the valves and commence drilling.

Where it is desired to drill for a period without coring, a plug-like bit can be substituted for the core barreling tube, and interengaged either with the pipe or with the annular bit, to rotate conjointly with the same.

Referring now to FIGS. 6–10, it will be seen that the drill rod in this embodiment also comprises an elongated fluid pressurized drill pipe 112 which is assembled from equal-diameter sections that are threaded and flush-coupled to one another as illustrated. In this embodiment, however, the distal end section 112' of the pipe does not differ from the other sections, since the bit 114 is telescoped onto the pipe and the hammer blows are transmitted to the rod through a shoulder 116 on the bit. The bit is connected with the pipe by means of an exteriorly threaded sleeve 118 which is flush-coupled to the distal end section of the pipe, and rabbetted so as to have a relatively enlarged shoulder section at the forward end 120 thereof, which in turn is axially fluted to form a band of axially extending splines 122 about the outer periphery of the sleeve. The bit 114 has an annular configuration of lesser and greater diametrical dimensions than that of the sleeve, but is counterbored from the rear to a diameter corresponding to that of the sleeve. Also, the counterbore 124 has axial fluting about the wall thereof, forming a band of axially extending splines 126 that are adapted to interengage with the band of splines 122 on the sleeve. The splines 126 of the bit terminate short of the shoulder 116, however, and are interrupted by an inner circumferential groove 128 adjacent the rear end 130 of the bit. The groove 130 is adapted to receive a split collar 132, and the collar is inserted in the same after the bit is telescoped about the sleeve 118 in the manner of FIGS. 7 and 8. In this way the bit can undergo axial displacement relative to the sleeve, but the collar provides a stop limiting the displacement endwise of the sleeve. Of course, inboard displacement of the bit is limited by the shoulder 116 of the counterbore 124 therein, when the shoulder abuts the forward end of the sleeve.

Like the sleeve 118, the bit 114 is also exteriorly rabbetted to its outer diameter, so that is has a relatively enlarged cross section at the forward end 134 thereof. The enlarged section is also axially fluted, although in this instance the flutes 136 are wider and provide a means for the hammer exhaust fluid to escape reentrantly into the annulus 138 formed between the pipe and the wall of the excavation. See FIGS. 7 and 8. Furthermore, as in the embodiment of FIGS. 1–5, the bit is equipped with sets of button-like percussive points 140 at the forward end thereof.

The sleeve 118 is also counterbored from the rear, although in this instance the shoulder 142 of the same is axially fluted to provide a band of axially extending splines 144 about the inner periphery of the sleeve at the forward end thereof. The utility of this band will be apparent shortly.

The motor 146 comprises a modified down-the-hole air hammer mechanism 148 similar to that which was employed in FIGS. 1–5, although in this instance the tubular casing 150 of the hammer mechanism is equipped with a sleeve extension 152 having a smaller internal diameter than that of the casing. Also, in this instance, the motor 146 comprises an anvil 154, the grooved, tubular shank or embossment 156 of which is slidably received in the sleeve 152 and retained in the casing by means of a split collar 154 interposed in the groove 156 thereof. Additionally, the main body or poll 158 of the anvil has a narrowerdiameter spigott 160 on the bottom or distal end thereof, which is adapted to telescope within the inner peripheral opening 162 of the annular bit 114, and the poll itself has a band of axially extending splines 164 about the outer periphery thereof, which are adapted to interengage with the band of splines 144 about the inner periphery of the sleeve 118 on the pipe 112. Furthermore, the spigott 160 is equipped with button-like percussive points 166 at the forward end thereof, so that the spigott not only plugs the opening 162, but also functions as a percussive bit as it rotates with the outer bit 114 due to the interengagement between the poll and the sleeve. Meanwhile, the hammer 168 drives the poll against the shoulder 116 of the outer bit, and the exhaust fluid from the hammer mechanism is fed into the operating face of the two bits through a series of outwardly angled ports 120 exiting from the bottom of the axial bore 172 of the anvil.

As indicated in the description of the embodiment of FIGS. 1–5, the control rod 82 of the hammer mechanism is ported and infrastructured so that the operating fluid exhausts through the porting 84 in the distal end 86 of the rod after each stroke of the hammer. That is, the hammer undergoes an alternate "blow cycle" condition after each stroke. The motor 146 in the embodiment of FIGS. 6–10 is also adapted so that the operator can put the hammer into the blow cycle at will, and hold it there, as for example, where there is an accumulation of cuttings in the excavation and the operator wants to flush them away before proceeding further with the drilling operation.

A cylindrical tube 174 is slidably interposed about the casing 150 of the hammer, between the bottom or distal end face or shoulder 176 of the cap 88 and the fluted shoulder 178 of the anvil. By halting the advance of the rod, while maintaining the pressure of the fluid, the operator can cause the inner band 144 of the sleeve on the pipe, to engage the tube 174, and the tube in turn to engage the shoulder 176 of the cap. This, in turn, will stall the advance of the hammer mechanism under the force of the fluid, and will put the mechanism into a continuous blow cycle. The same action will occur, moreover, when the bits 114 and 154 get too far ahead of the pipe, since the tube 174 is sized in length so that the condition is achieved before the stroke of the hammer advances the bits beyond the point at which the collar 132 will engage the band 122 of the sleeve. Thus, there is no risk the hammer will drive the bits off of the pipe. See FIG. 8 wherein the tube 174 is engaged with the cap and the sleeve under normal drilling conditions.

Otherwise, the apparatus operates in much the same manner as that in FIGS. 1–5. That is, the cap 88 of the hammer mechanism operates as a piston-like member, and the pressurized fluid above the same provides a resilient hold-down force, while simultaneously entering the hammer mechanism through the ports 90 to operate the hammer, and alternately, to escape into the operating face of the bits to flush the cuttings from the excavation.

The cap 88 may have a seal therearound, to prevent leakage of the fluid therepast, or the cap may be adapted as a leak-by piston that provides the necessary pressure differential thereacross.

Figure 9:
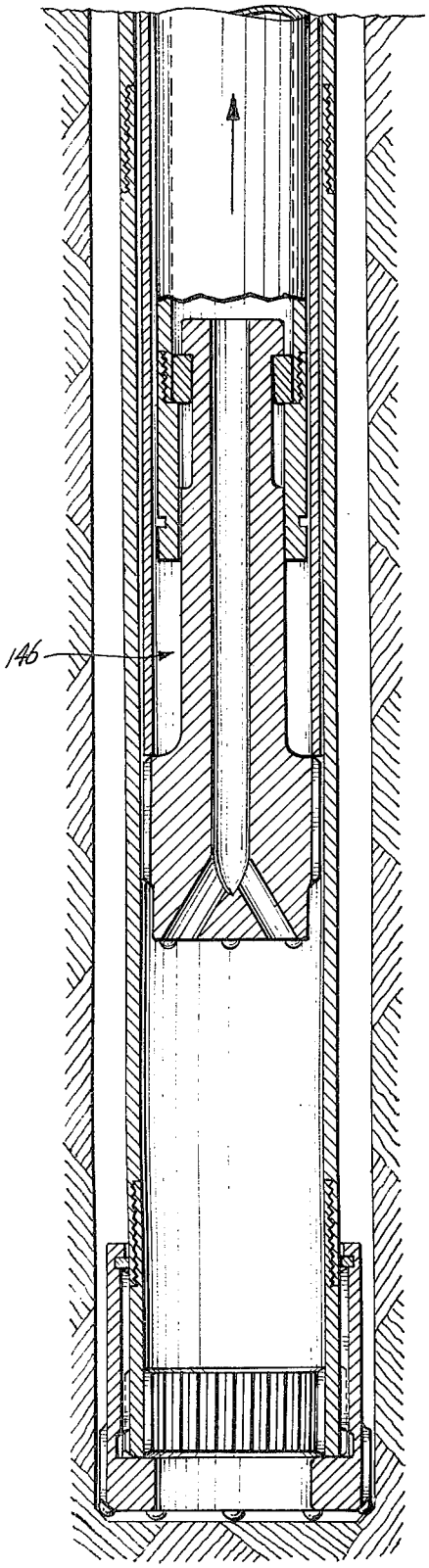
FIG. 9 is another such view of the second embodiment illustrating the manner in which the motor can be removed from the drill rod to make way for a hole casing in the rod.
Figure 10:
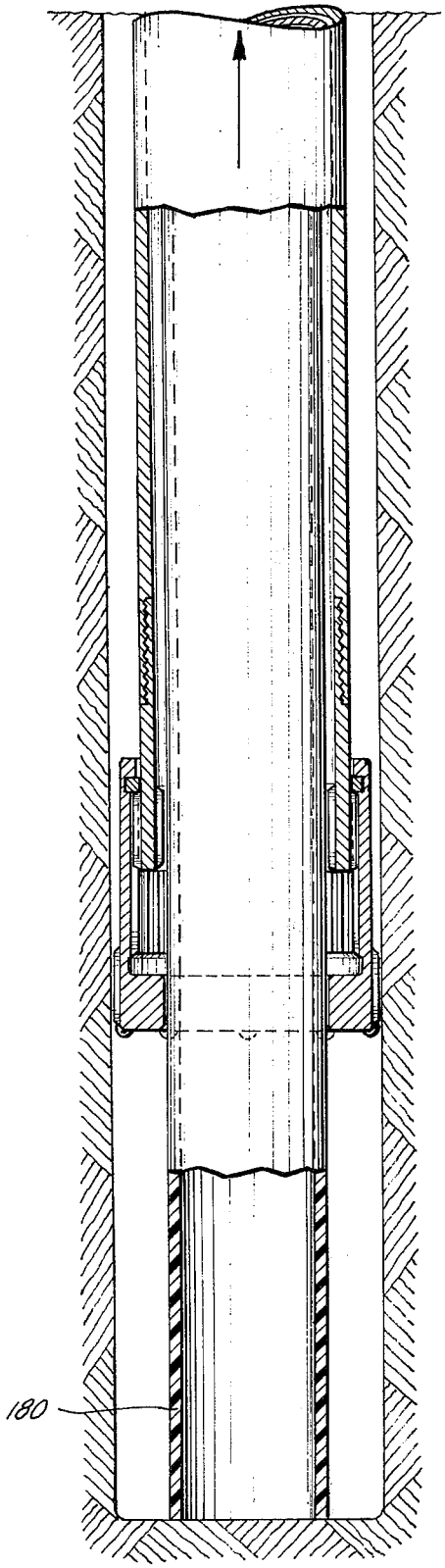
FIG. 10 is another such view illustrating the manner in which the drill rod can be withdrawn from the hole around the casing, after the casing is installed in the rod.

FIGS. 9 and 10 illustrate the manner in which the device can be employed to case the excavation cut by it. As seen in FIG. 9, the motor 146 is retracted from the drill rod so as to open the bore of the same from end to end thereof. Then in FIG. 10, a plastic tube 180 or other casing is inserted in the bore, and the drill rod is withdrawn from the excavation around it.

The pipe 112 and the annular bit 114 may be adapted so that the bit can be dropped off in the manner of U.S. Pat. No. 3,391,543, and in such a case, the tube 180 can be sized up to the inner diameter of the pipe, that is, sized larger than the inner peripheral opening 162 of the bit 114.

FIGS. 11–19 illustrate the manner in which a bite-quipped anvil and a core-barrel-equipped anvil can be interchanged with one another, as for example, where the bit-equipped anvil is employed in the motor to drill a hole through overburden, and then a core-barrel-equipped anvil is substituted to take core samples thereunder.

In FIG. 11, the pipe is equipped with a flush-coupled sleeve extension 182 that is exteriorly and interiorly rabbetted to provide a thickened cross section at the forward end thereof, the inner and outer peripheries of which are axially fluted as in the embodiment of FIGS. 6–10. In this instance, however, the flutes 184 about the inner periphery of the sleeve 182 are considerably wider, as are the ridges 186 of the splines 187 therebetween. Moreover, the ridges 186 are described by a cylindrical surface of revolution so as to present smooth cylindrical faces to the interior of the extension. The outer bit 188 is similar to that seen in FIGS. 6–10, although the impact shoulder 190 of the bit is wider and has a series of symmetrically angularly spaced ports 192 therein which open into the face of the bit at acute angles to the axis of the same. Again, as in FIGS. 6–10, the bit 188 is engaged on the sleeve extension 182 of the pipe and is secured to the same by a split collar 132.

Figure 12:
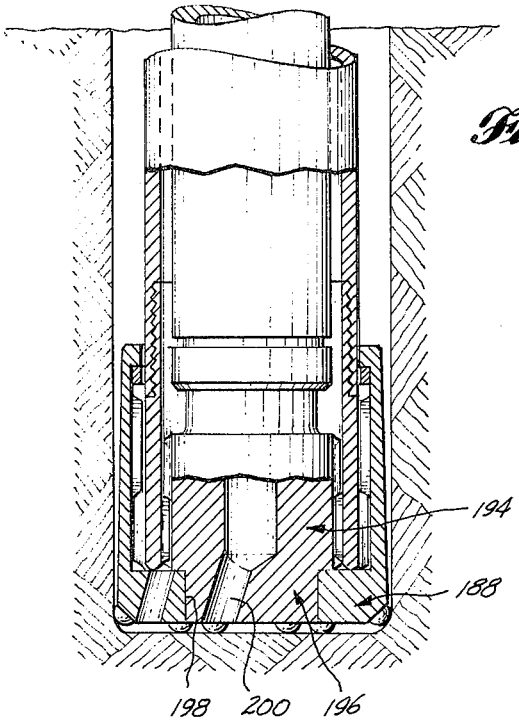
FIG. 12 is a part longitudinal cross-sectional view of the third embodiment in the drilling phase of the alternate operation.
Figure 13:
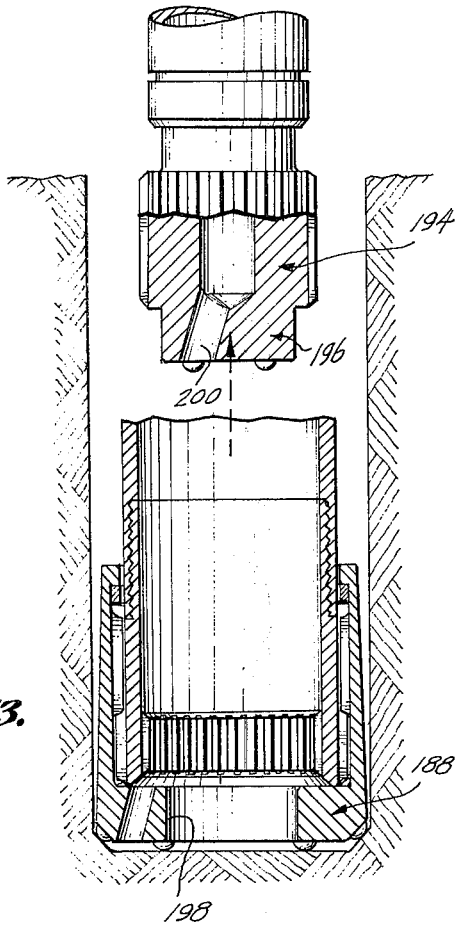
FIG. 13 is another such view of the third embodiment in which the motor is being withdrawn from the rod so that the apparatus can be converted to a core barreling device.
Figure 14:
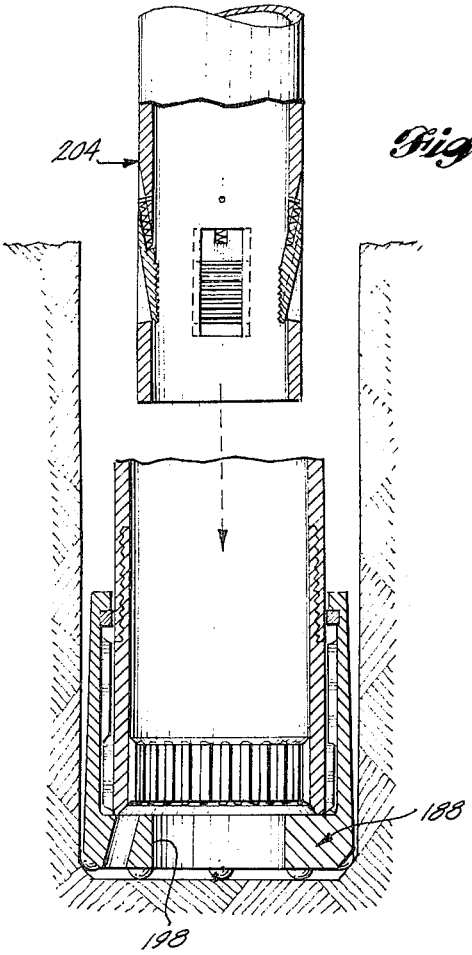
FIG. 14 is a third such view in which the converted motor is being reintroduced to the rod after the conversion.

In the drilling phase of the operation, FIG. 12, the anvil 194 is equipped with a spigotted bit 196 on the distal end thereof, as in FIGS.6–10, and is exteriorly splined to interengage with the splines 187 of the sleeve 182 as the bit telescopes within the inner peripheral opening 198 of the annular bit 188. Moreover, the operating fluid is exhausted through a series of ports 200 in the face of the bit 196, as in FIGS. 6–10. However, when the drilling phase is completed, the motor 146 is withdrawn from the rod in the manner of FIG. 13, and a modified motor is inserted in the manner of FIG. 14 to conduct the core barreling phase.

Figure 15:
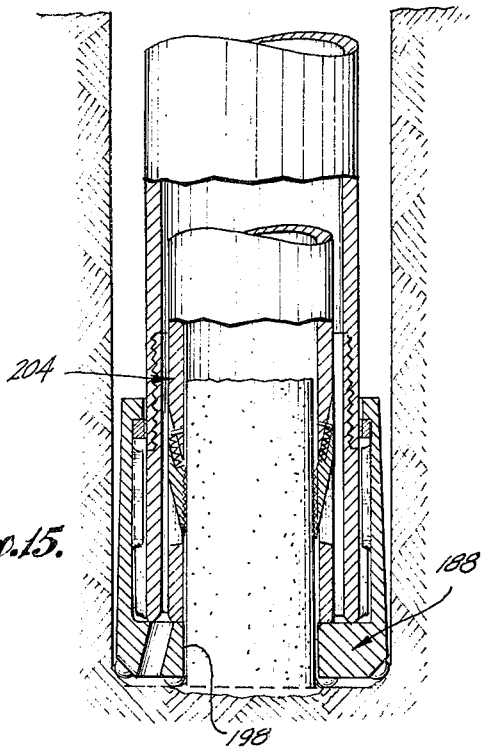
Figure 16:
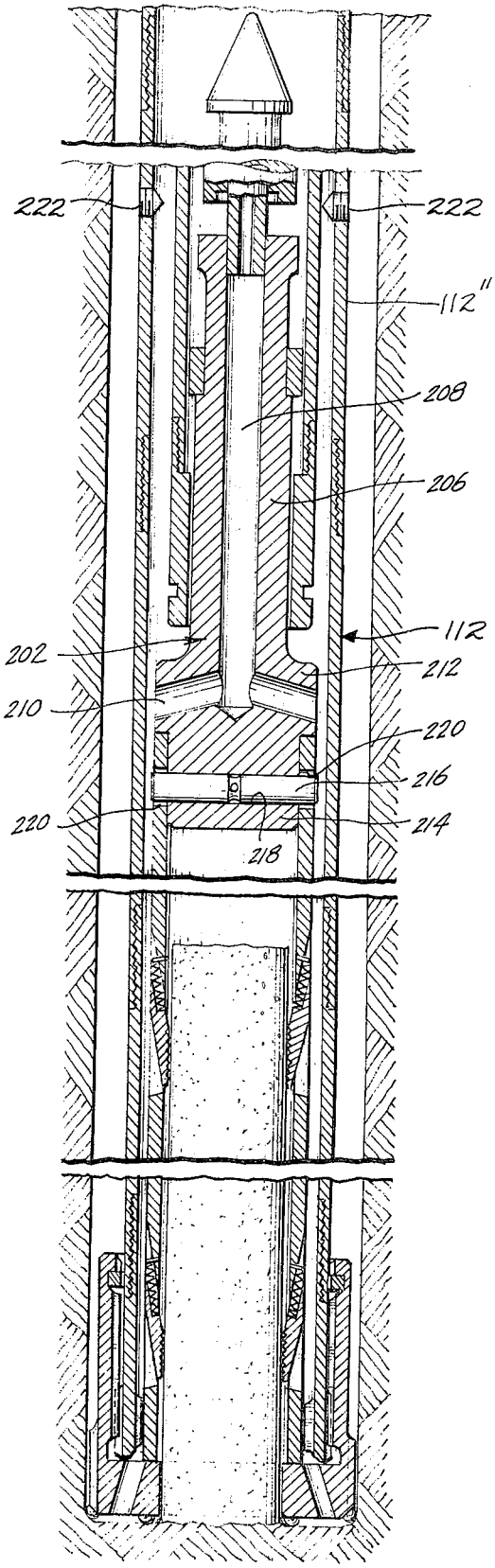
FIG. 16 is a more complete longitudinal cross-sectional view of the third embodiment in the core barreling phase and when the hammer is in the raised or actuated condition thereof.
Figure 17:
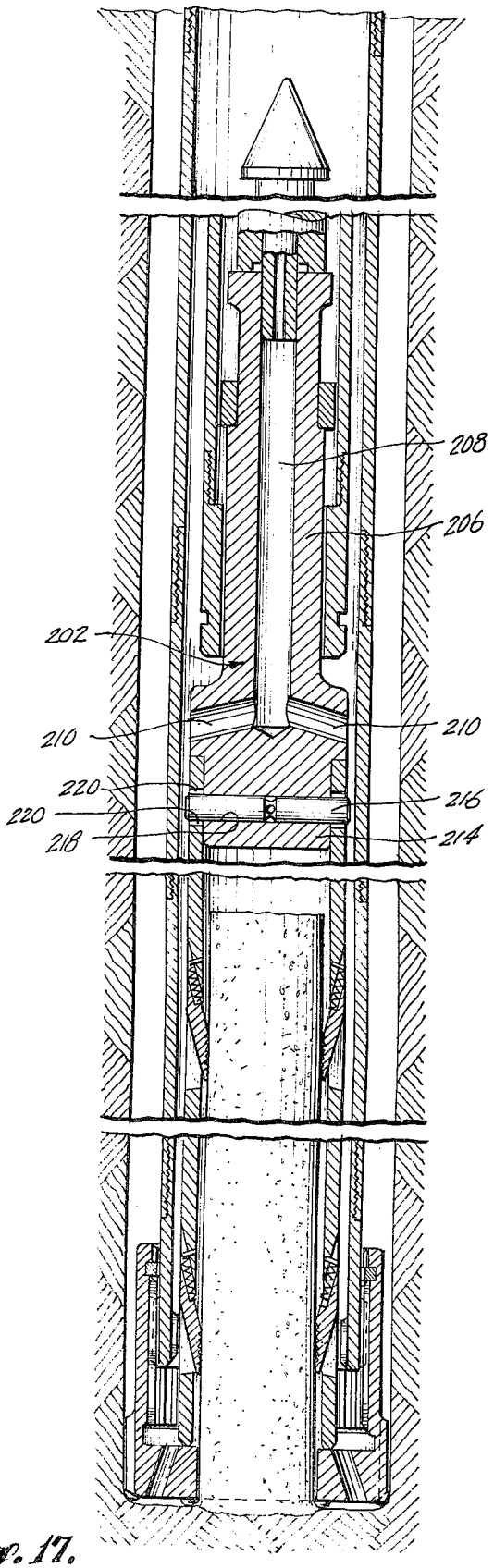
FIG. 17 is another such view when the hammer is in the deactuated "blow-cycle" condition thereof.

The modified motor includes an anvil 202 which transmits the hammer blows to the annular bit 188 through a core barrel tube 204. The neck-like shank 206 of the anvil is slidably received in the case of the hammer and is secured against escape by means of a split collar 154, as in the earlier embodiments. However, the bore 208 of the shank is ported laterally of the anvil through a series of angularly distributed ports 210 in the poll 212 above the spigott 214. Moreover, the spigott is employed as a means for interengaging the anvil with the core barrelling tube 204. As seen in FIGS. 16 and 17, the spigott is telescoped into the upper end of the tube, and is fastened to the same by a pin 216 inserted through a crosswise aperture 218 in the spigott, as well as through each of a pair of diametrically opposed slots 220 in the wall of the tube. The slots 220 are oversized to allow a small amount of axial play between the anvil and the tube, and as seen in FIGS. 15–17, the tube 204 is sized to slidably engage with the ridges 186 of the splines 187 in the sleeve 182 to engage the shoulder 190 of the bit 188. Thus, when the hammer strikes the anvil, the blows are transmitted through the tube to the bit, there being sufficient play between the pin 216 and the slots 220 to allow for the necessary recoil on the part of the anvil. Meanwhile, the operating fluid is exhausted through the ports 210, and thence downwardly about the tube 204, through the flutes 184, and out the ports 192 in the body of the bit 188.

In lieu of the stop tube 174 in FIGS. 6–10, one distal end section 112 in. of the pipe is equipped with diametrically opposed stop screws 222 which engage the cap 88 of the hammer at the shoulder 176 thereof to limit the travel of the hammer mechanism relative to the pipe, and vice versa, and place the hammer in the blow cycle before the stop collar 132 in the outer bit 188 engages the band 224.

When it is desired to remove the core sample 225 from the tube 204, the motor is retracted from the bore of the pipe and anvil 202 is unpinned from the tube, or vice versa, so that the sample can be forceably ejected from the tube by applying a plunger (not shown) to the lower end of the same. During the coring phase, moreover, the sample is retained in the tube by sets of core catcher means 226 which are disposed about the inner periphery of the tube. As seen in FIG. 11 and FIGS. 16–19, the tube has sets of symmetrically angularly spaced slots 228 in the wall thereof, at two or more levels vertically of the tube. The slots have upper faces 230 that are canted to the axis of the tube, and similarly inclined grooves 232 in the side walls of each slot. The grooves have T-cross-sectioned shoes 234 therein which are trapezoidally cross-sectioned longitudinally thereof, and each equipped with a carbide chipped face 236 on the lower trapezoidal end thereof. Each shoe also has an elongated groove 238 routed from the upper face thereof, and the groove 238 terminates in the body of the shoe at each end so that a coiled spring 240 can be caged in the groove between the lower end of the same and a stop pin 242 inserted in the upper end thereof. The stop pin is inserted into the groove from an aperture 244 which opens into the slot 228 through the upper face 230 thereof.

The pressure of the springs 240 is adapted to drive the shoes downwardly into the bore of the tube. Yet when the core sample forms in the bore, the shoes are driven upwardly and outwardly in their slots against the bias of the springs, due to the angle of the sample relative to the faces 236 of the shoes. On the other hand, once the sample is formed in the bore, it is prevented from escaping by the fact that the weight of the same, downwardly of the tube, operates in the direction of driving the shoes inwardly of the bore under the bias of the springs, thereby causing the shoes to bindingly engage or "wedge" with the sample, to prevent its escape. See FIG. 18.

What is claimed is:

1. In a drilling apparatus of the type wherein a piston-like means having a fluid operated hammer mechanism thereon is retractably slidably inserted in the bore of a rotary drill rod comprising an elongated pipe having a longitudinally extending bore therethrough and a percussive bit at the distal end thereof, and the hammer of the mechanism is operatively applied to an abutment which is relatively transverse the bore adjacent the bit and operatively connected with the bit to receive and transmit the hammer blows into the working face of the bit, and wherein the fluid transmission means for operating the hammer mechanism include means for passing fluid through the piston-like means and means for exhausting the fluid into the region adjacent the working face of the bit after the mechanism has operated, and there are means on the rod whereby the exhausted fluid can discharge from said region toward the proximal end of the pipe on the opposite side of the pipe from the piston-like means, and means on the piston-like means for generating a pressure differential thereacross longitudinally of the bore to maintain the hammer mechanism in operative relationship to the abutment during the application of the hammer thereto, the feature of said bit being annular and having an inner bit adjacent the opening thereof which is retractably suspended from the piston-like means and operatively interengaged with the drill rod to rotate in conjunction with the annular bit.

2. The drilling apparatus according to claim 1 wherein the inner bit has a fluid passage therethrough and the fluid is exhausted through the passage into the region adjacent the working face of the bit after the hammer mechanism has operated.

3. The drilling apparatus according to claim 1 wherein the pipe is conjointly rotatable with the bits.

4. The drilling apparatus according to claim 3 wherein the annular bit is displaceable in relation to the pipe, axially of the bore.

5. The drilling apparatus according to claim 4 wherein the annular bit is splined to the pipe axially of the bore.

6. The drilling apparatus according to claim 1 wherein the respective bits are splined to one another axially of the bore.

7. In a drilling apparatus of the type wherein a piston-like means having a fluid operated hammer mechanism thereon is retractably slidably inserted in the bore of a rotary drill rod comprising an elongated pipe having a longitudinally extending bore therethrough and a percussive bit at the distal end thereof, and the hammer of the mechanism is operatively applied to an abutment which is relatively transverse the bore adjacent the bit and operatively connected with the bit to receive and transmit the hammer blows into the working face of the bit, and wherein the fluid transmission means for operating the hammer mechanism include means for passing fluid through the piston-like means and means for exhausting the fluid into the region adjacent the working face of the bit after the mechanism has operated, and there are means on the rod whereby the exhausted fluid can discharge from said region toward the proximal end of the pipe on the opposite side of the pipe from the piston-like means, and means on the piston-like means for generating a pressure differential thereacross longitudinally of the bore to maintain the hammer mechanism in operative relationship to the abutment during the application of the hammer thereto, the feature of the bit being annular and having an excavation means adjacent the opening thereof which is retractably suspended from the piston-like means and operatively interposed between the hammer mechanism and the bit to receive and transmit the hammer blows into the working face of the bit.

8. The drilling apparatus according to claim 7 wherein the excavation means takes the form of an inner bit.

9. The drilling apparatus according to claim 8 wherein the annular bit has an annular shoulder thereon and the inner bit is seated on the shoulder.

10. The drilling apparatus according to claim 7 wherein the excavation means takes the form of a core barrel.

* * * * *